US005171161A

United States Patent [19]

Kachlic

[11] Patent Number: 5,171,161

[45] Date of Patent: Dec. 15, 1992

[54] ELECTRICAL CONNECTOR ASSEMBLIES

[75] Inventor: Jerry D. Kachlic, Clementi Park, Singapore

[73] Assignee: Molex Incorporated, Lisle, Ill.

[21] Appl. No.: 870,728

[22] Filed: Apr. 15, 1992

Related U.S. Application Data

[63] Continuation of Ser. No. 698,746, May 9, 1991, abandoned.

[51] Int. Cl.[5] ..... H01R 13/627

[52] U.S. Cl. ..... 439/352; 439/607; 439/701

[58] Field of Search ..... 439/686, 701, 345, 350-357, 439/607-610

[56] References Cited

U.S. PATENT DOCUMENTS

| | | | |
|---|---|---|---|
| Re. 32,864 | 2/1989 | Ezure | 439/152 |
| 3,042,894 | 7/1962 | Fox | 439/701 X |
| 3,072,340 | 1/1963 | Dean | 439/701 X |
| 3,137,535 | 6/1964 | Collier et al. | 439/350 |
| 3,605,068 | 9/1971 | Rayburn | 439/350 X |
| 4,337,989 | 7/1982 | Asick et al. . | |
| 4,596,436 | 6/1986 | Kraemer et al. | 439/701 |
| 4,682,839 | 7/1987 | Bryce | 439/598 |
| 4,753,613 | 6/1988 | Morgan | 439/701 |
| 4,787,860 | 9/1988 | Bender | 439/358 |
| 4,810,210 | 3/1989 | Komatsu | 439/610 |
| 4,900,262 | 2/1990 | Matsuzaki | 439/354 |
| 4,908,335 | 3/1990 | Cosmos et al. | 439/609 X |
| 4,915,642 | 4/1990 | Lin et al. | 439/352 |
| 4,954,097 | 9/1990 | Sekiguchi | 439/352 |
| 5,011,424 | 4/1991 | Simmons | 439/352 |
| 5,013,262 | 5/1991 | Shibano | 439/353 X |
| 5,021,002 | 6/1991 | Noschese | 439/352 |

FOREIGN PATENT DOCUMENTS

| | | | |
|---|---|---|---|
| 2135728 | 9/1979 | Fed. Rep. of Germany | 439/701 |

*Primary Examiner*—Larry I. Schwartz
*Assistant Examiner*—Khiem Nguyen
*Attorney, Agent, or Firm*—Charles S. Cohen

[57] ABSTRACT

An electrical connector system is disclosed and includes a plug connector assembly mateable with a right angle header connector assembly. The plug connector assembly includes a plurality of terminal-receiving modules juxtaposed in a nested array in a cavity in a housing. The right angle header connector assembly includes a plurality of generally flat terminal modules nested within a cavity in a housing in a side-by-side relationship. Each terminal module of the header connector assembly includes a plurality of generally coplanar flat terminals surrounded and maintained in a desire array by an overmolded module encasement. The terminals have opposite terminal portions projecting from the encasement. Both the plug connector assembly and the header connector assembly are shielded connectors and each include a shield about a substantial portion of the respective connector assembly. The connector assemblies are held in mated condition by latches which are actuated by a cover mounted for relative movement about the plug connector assembly.

7 Claims, 5 Drawing Sheets

ELECTRICAL CONNECTOR ASSEMBLIES

This is a continuation of copending application Ser. No. 07/698,746 filed on May 9, 1991 now abandoned.

FIELD OF THE INVENTION

This invention generally relates to the art of electrical connectors and, particularly, to an electrical connector system which includes a plug connector assembly for terminating a multi-conductor cable and a mating right angle connector assembly in the form of a header for connection to a substrate such as a printed circuit board or the like.

BACKGROUND OF THE INVENTION

Electrical connectors have been provided in a wide variety of configurations for terminating multi-conductor cables. With the ever-increasing miniaturization of electrical connectors and the ever-increasing numbers of wires of multi-conductor cables, electrical connectors of the character described have become increasingly complicated in order to accommodate relatively large numbers of conductors terminated in relatively small connectors. This is particularly true when the multi-conductor cable is a shielded cable and, consequently, the electrical connector must have shielding capabilities, such as providing shielding means for the terminals in the connectors as well as terminal portions projecting from the connectors at the interface with a mating connector.

Because of the ever-increasing miniaturization of such electrical connectors, along with their high density terminal configurations, extraneous connector hardware for facilitating assembly of the connector components practically has been made prohibitive, and assembly of the connectors often must be accomplished by interengageable and complementarily configured connector components which are assembled together by elements or parts of the components themselves fitting together in a fixed relationship in final assembly. This becomes very difficult to accomplish and still provide desirable features in the connector, such as various latch means for the connector components, proper shielding for the connector terminals, latch means between mating connectors and the like. Providing a simple electrical connector system of the character described in a modular configuration further complicates the design of the system in high density miniaturized connectors.

This invention is directed to providing an electrical connector system of the character described in a plug and header connector assembly structure which is easy to assemble and reliable in terminating the conductors to respective terminals, the system incorporating a substantially modular design.

SUMMARY OF THE INVENTION

An object, therefore, of the invention is to provide a new and improved electrical connector system for high density applications.

In the exemplary embodiment of the invention, generally, the electrical connector system of the invention includes a shielded modular plug connector assembly and a shielded modular receptacle or header connector assembly, the header connector assembly being disclosed in a right-angled configuration for connection to a substrate such as a printed circuit board or the like.

In the preferred embodiment of the invention, the plug connector assembly includes a housing having an open-ended cavity. A plurality of terminal-receiving modules are sized and shaped to be juxtaposed in a nested array for positioning in the cavity of the housing through one open-end thereof. Complementary interengageable latch means are provided between the housing and each terminal-receiving module to hold all the modules in their nested array in the cavity.

As disclosed herein, the housing of the plug connector assembly and all of the terminal-receiving modules are unitarily molded of dielectric material. The complementary interengageable latch means are provided in the form of a common latch rib disposed on the inside of the cavity of the housing extending along the entire array of modules, and individual latch projections molded on the outside of each module and interengageable with the common latch on the inside of the cavity. The cavity is generally rectangularly shaped, and the modules are elongated with lengths generally equal to one cross-dimension of the rectangular cavity and with widths totalling the opposite cross-dimension of the rectangular cavity.

The plug connector assembly is a shielded electrical connector and includes top and bottom conductive shield sections positionable over the top and bottom, respectively, of the connector housing. Each shield section includes side walls overlying the sides of the housing. Complementary interengageable latch means are provided between the sides of the housing and the side walls of each shield section for holding the shield sections on the housing. In the preferred embodiment of the invention, the connector housing is molded with generally horizontal grooves in each side thereof. The shield sections are fabricated of stamped and formed sheet metal material and include tabs for snapping into the grooves of the housing.

A feature of the invention is the provision of a cover about the plug connector assembly for facilitating mating and unmating of the plug connector assembly with the receptacle or header connector assembly. More particular, one of the shield sections of the plug connector assembly includes at least one latch arm normally biased outwardly of the plug connector assembly. The latch arm is movable between an outwardly biased, operative latching position when the connector assemblies are mated and an inwardly biased, inoperative unlatching position to allow unmating of the connector assemblies. The outer cover is movable relative to the shield and inner housing of the plug connector assembly in a mating/unmating direction. Complementary engageable cam means are provided between the outer cover and the latched arm for moving the latch arm to the inoperative unlatching position when the cover is moved relative to the connector assembly in the unmating direction, and for allowing movement of the latch arm to the operative latching position when the cover is moved relative to the plug connector assembly in the mating direction.

In the exemplary embodiment of the invention, the receptacle or header connector assembly includes a housing defining a module-receiving cavity. Generally, a plurality of generally flat terminal modules are nested within the cavity in a side-by-side relationship. Each terminal module includes a plurality of generally coplanar flat terminals surrounded and maintained in a desired array by an overmolded module encasement. The terminals have terminal portions projecting from the encasement.

In the preferred embodiment of the invention, the terminals of the header connector assembly are fabricated of stamped and formed sheet metal material. The overmolded modular encasements are fabricated of dielectric material such as molded plastic. The housing includes open ends in generally perpendicular planes to define a right-angled configuration of the header connector assembly. The terminals are configured in right angles with opposite ends projecting from the open ends of the housing. The terminal modules include interengaging locking means molded integrally with opposite sides thereof for holding the modules together in their side-by-side relationship within the cavity in the housing. The housing has locking means at opposite sides of the cavity for locking engagement with the end-most modules of the plurality of modules in the side-by-side relationship within the housing.

The right-angled header connector assembly is a shielded connector. A unitary conductive shield is positioned about the housing and includes a top wall covering at least a portion of the top of the housing, opposite side walls covering at least portions of the respective sides of the housing, and shroud wall means substantially surrounding ends of the terminals which project from the front of the housing. The unitary conductive shield is fabricated in one piece of stamped and formed metal material. Latch means are provided between the housing and the unitary conductive shield to hold the shield on the housing. The front of the housing is generally rectangularly shaped, and the shroud wall means of the unitary conductive shield is formed by four walls defining a rectangular shroud complementary to the rectangular shape of the front of the housing.

A further feature of the invention concerns the terminals in the plug connector assembly and the terminals in the receptacle or header connector assembly. Specifically, the terminals in the plug connector assembly are female terminals each having a pair of generally parallel opposing jaws. The terminals of the header connector assembly are male terminals fabricated of stamped and formed sheet metal material. The invention contemplates that the male terminals be oriented such that the smooth sides of the sheet metal material from which the male terminals are fabricated engage the jaws of the female terminal when the connector assemblies are mated.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figures 1, 2:
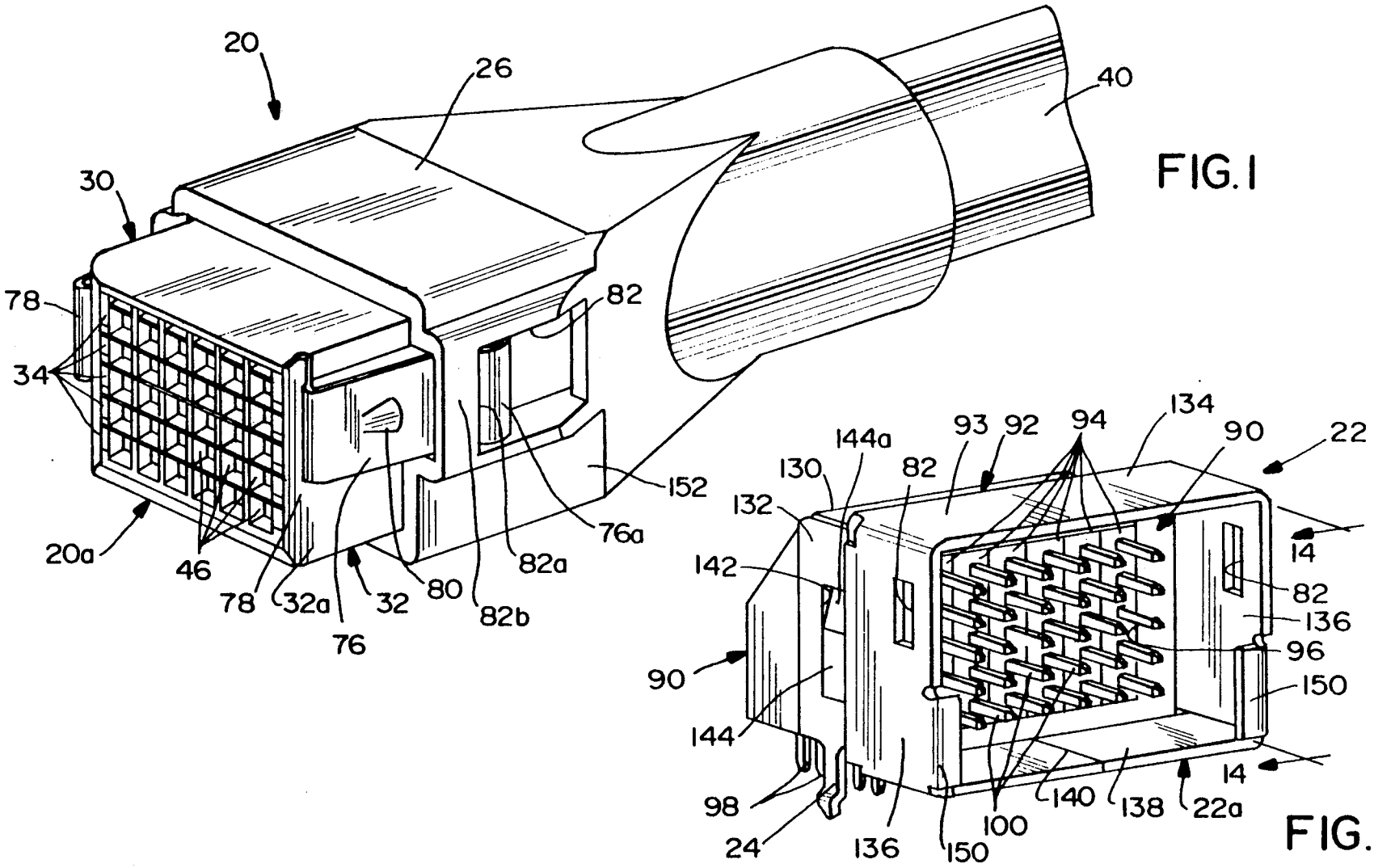
FIG. 1 is a perspective view of the plug connector assembly of the electrical connector system of the invention.
FIG. 2 is a perspective view of the right angle receptacle or header connector assembly of the electrical connector system of the invention.

Referring to the drawings in greater detail, and first to FIGS. 1 and 2, the invention is embodied in an electrical connector system which includes a first connector assembly, generally designated 20 (FIG. 1), and a second connector assembly, generally designated 22 (FIG. 2). Connector assembly 20 is in the form of a plug connector assembly, and connector assembly 22 is in the form of a right angle receptacle or header connector assembly. Plug connector assembly 20 includes a plug end, generally designated **20*a* (FIG. 1), for insertion into a receptacle end, generally designated 22*a* (FIG. 2), of header connector assembly 22. The header connector assembly is designed for mounting on a substrate, such as a printed circuit board or the like, and includes board lock legs 24**, as described in greater detail hereinafter.

Figure 3:
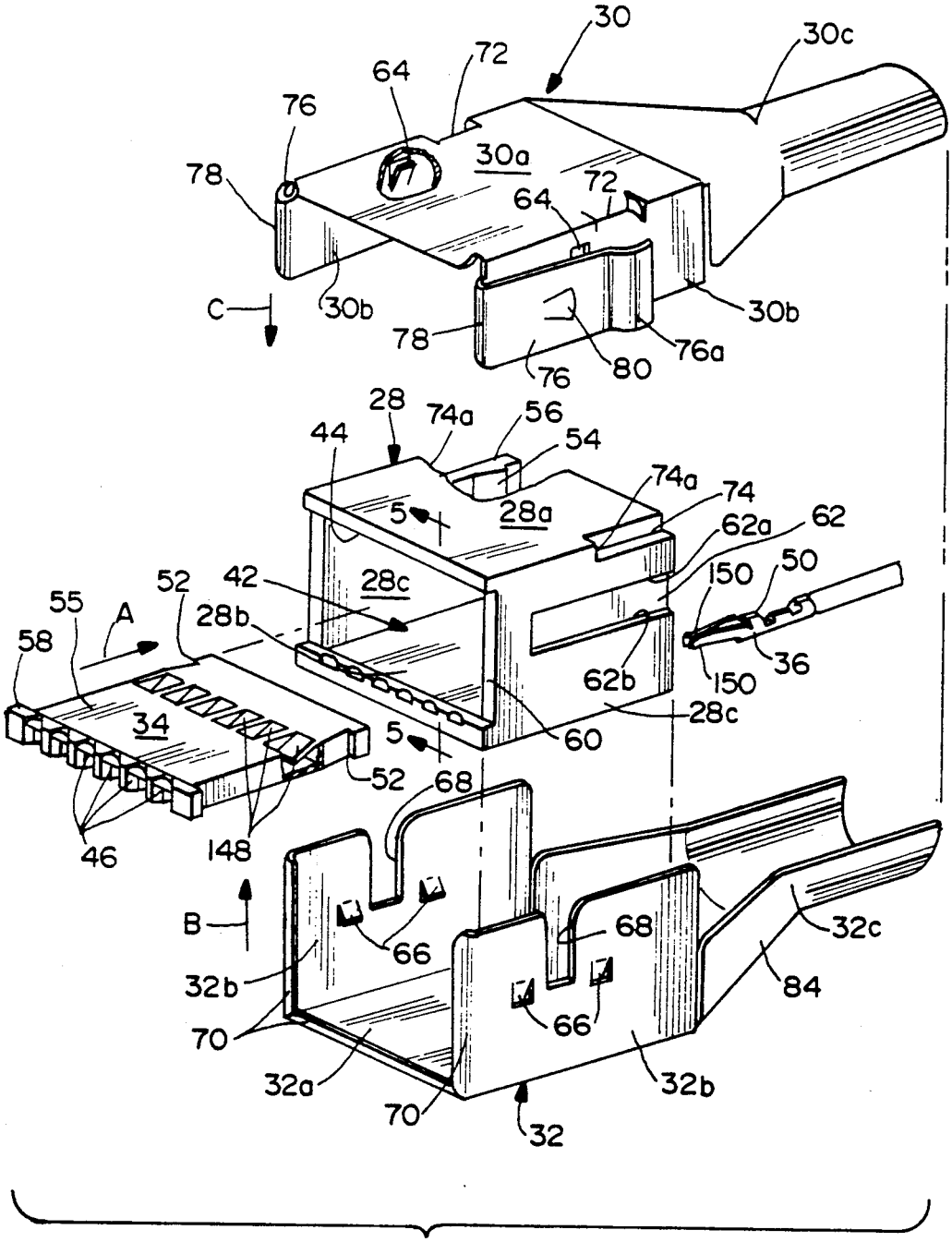
FIG. 3 is an exploded perspective view of the major components of the plug connector assembly of FIG. 1, with the cover removed to facilitate the illustration.

Referring to FIG. 3 in conjunction with FIG. 1, plug connector assembly 20 includes a dielectric outer cover 26 (FIG. 1), an inner dielectric housing, generally designated 28 (FIG. 3), a top shield section, generally designated 30, a bottom shield section, generally designated 32, a plurality of terminal-receiving modules 34 positionable within housing 28, and a plurality of female terminals 36 mounted within each module 34. Each terminal 36 is terminated to a discrete electrical wire 38, as by crimping, and the discrete wires form a multi-conductor cable 40 (FIG. 1).

As seen best in FIG. 3, inner housing 28 of plug connector assembly 20 includes an open-ended cavity 42 defined by a top wall **28*a*, a bottom wall 28*b* and opposite side walls 28*c*. Cavity 42 defines a front mouth 44** into which modules 34 are inserted in the direction of arrow "A".

Although only one terminal-receiving module 34 is shown in FIG. 3, it can be seen in FIG. 1 that a plurality of the modules are sized and shaped to be juxtaposed in a nested array for positioning in cavity 42 of housing 28 through mouth 44 thereof. Each module 34 has a plurality of channels extending between forward pin-receiving openings 46 to the rear of the module whereby female terminals 36 can be either rear loaded into the modules or loaded from the open side of the channels. When the modules are stacked on top of each other, the top surface 55 of each module encloses the channels of the module 34 above it. Each module has a plurality of latching tabs 48 (FIG. 3) for latching behind shoulders 50 of terminals 36 to hold the terminals in the channels in the modules. Although the precise numbers are not limiting, it can be seen that each module 34 has six pin-receiving openings 46 for receiving six terminals 36. As seen in FIG. 1, five modules 34 are juxtaposed in a stacked array within the connector assembly whereby the forward plug end 20*a* of the connector assembly presents five rows of six pin-receiving openings. It also can be seen in FIG. 3 that each module 34 has individual latch shoulders 52 in opposite sides thereof near the rear of the module.

Figure 4:
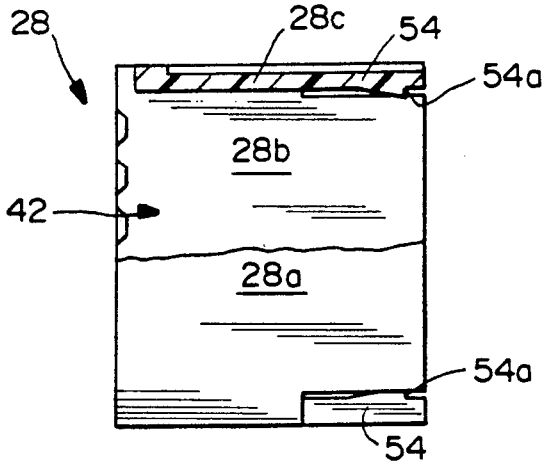
FIG. 4 is a top plan view, partially in section, of the housing of FIG. 3.
Figure 5:
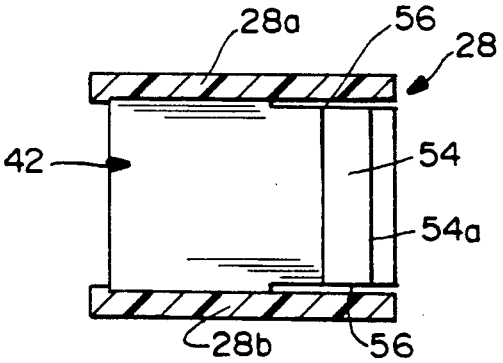
FIG. 5 is a vertical section taken generally along line 5—5 of FIG. 3.

Referring to FIGS. 4 and 5 in conjunction with FIG. 3, it can be seen that inwardly projecting, vertical ribs 54 extend along the inside of side walls 28*c* of housing 28. These ribs define latching shoulders 54*a* for engagement behind latch shoulders 52 of the modules to hold the modules in the housing. The side walls have horizontal slits, as at 56 (FIG. 5), to provide resiliency for the rear areas of the side walls. Consequently, when modules 34 are inserted into cavity 42 of the housing, the rear portions of the side walls are biased outwardly and, when the modules are fully inserted into the housing, latch shoulders 52 and 54*a* snap into latching engagement. It can be seen in FIG. 3 that each module 34 has a front, outwardly projecting flange 58 which abuts against front edges 60 of side walls 28*c* to define the fully inserted positions of the modules in which latch shoulders 52 and 54*a* are in latching engagement. Each of housing 28 and all of the terminal-receiving modules 34 are unitarily molded of dielectric material, with latch shoulders 52, ribs 54 and latch shoulders 54*a* all being integrally molded with their respective components.

From the foregoing, it can be seen that latch shoulders 52, ribs 54 and latch shoulders 54*a* combine to provide complementary interengaging latch means between housing 28 and modules 34 to hold all of the modules in their nested array within cavity 42 of the housing. Ribs 54 and latch shoulders 54*a* form a common latch means on the housing extending along the entire height of the array of modules for interengagement with the individual latch shoulders 52 of the individual modules. It also can be seen that cavity 42 is generally rectangularly shaped, and the modules are elongated with lengths (widths as viewed in the drawings) generally equal to one cross-dimension of the rectangular cavity, and with the widths (heights as viewed in the drawings) of the modules totalling the opposite cross-dimension of the rectangular cavity.

Still referring to FIG. 3 in conjunction with FIG. 1, terminals 36 are located within modules 34 which, in turn, are disposed within housing 28 and the entire assembly is shielded by top shield section 30 and bottom shield section 32 which are snap-fit onto housing 28. More particularly, groove 62 is molded integrally along the outside of side walls 28*c* of housing 28. The grooves define upper ledges 62*a* and lower ledges 62*b*. The shield sections are fabricated of stamped and formed metal material. Top shield section 30 includes a top wall 30*a* and opposite side walls 30*b*, with a cable shroud portion 30*c* projecting from the rear thereof. Each side wall 30*b* of top shield section 30 includes an inwardly formed tab 64 located for snapping beneath upper ledge 62*a* of slot 62 in the respective juxtaposed side wall 28*c* of housing 28. Similarly, bottom shield section 32 includes a bottom wall 32*a*, opposite side walls 32*b* and a cable shroud portion 32*c* projecting rearwardly of the shield. Side walls 32*b* each include a pair of formed tabs 66 for snapping above lower ledges 62*b* of grooves 62 in the outside of side walls 28*c* of housing 28. Side walls 32*b* of bottom shield section 32 also have cut-out portions 68 in their upper edges for accommodating tabs 64 of top shield section 30, for purposes described below.

In assembly of plug connector assembly 20, bottom shield section 32 is moved upwardly in the direction of arrow "B" (FIG. 3) over housing 28 until tabs 66 snap above lower ledges 62*b* of grooves 62 of the housing. The forward edges of bottom wall 32*a* and side walls 32*b* of the bottom shield section are provided with inwardly directed flanges 70 for abutting against the front of housing 28 and the front faces of flanges 58 of modules 34. Once the bottom shield section is snapped into position, top shield section 30 is moved downwardly in the direction of arrow "C", with side walls 30*b* of the top shield section overlying the side walls of the bottom shield section, until tabs 64 snap below upper ledges 62*a* of grooves 62 in the side walls of the housing. Cut-outs 68 in the bottom shield section accommodate movement of tabs 64 in the top shield section to their latched positions beneath upper ledges 62*a*. Top shield section 30 has indented corner portions 72 at the junctures of the top wall and side walls thereof for positioning into recessed areas 74 of housing 28. The forward ends of indented corners 72 abut against a shoulder 74*a* defined by recessed areas 74. It can be seen that the top and bottom shield sections 30 and 32, respectively, combine to completely enclose the top, bottom and sides of housing 28 to shield terminals 36 within modules 34 disposed within cavity 42. Cable shroud portions 30*c* and 32*c* combine to completely surround the interfacing area between multi-conductor cable 40 and its discrete wires 38 which are terminated to terminals 36.

A crimpable collar 75 (FIGS. 6 and 7) is slid over cable 40 when assembly of the connector 20 is initiated. The outer insulation of the shielded cable is stripped away exposing the shielding (not shown) of the cable. After the top 30 and the bottom 32 shield halves are assembled onto housing 28, crimpable collar 75 is slid over the cable shroud portions 30*c* and 32*c* which are in contact with the shielding of the cable. The collar 75 is then crimped in known manner deforming the collar and the cable shroud portions 30*c* and 32*c*.

A feature of the invention is the design of outer cover 26 (FIG. 1) so that the cover is movable relative to the assembled shield sections 30, 32 and housing 28 therewithin; the cover being used to actuate a latching means between plug connector assembly 20 and header connector assembly 22. More particularly, referring again to FIG. 3 in conjunction with FIG. 1, top shield section 30 is provided with a pair of latch arms 76 formed integrally with the shield and bent back from the front edges of side walls 30*b*, as at 78. Each latch arm has a latching tab 80 stamped therein and positioned for snapping engagement within apertures 82 (FIG. 2) of header connector assembly 22. The latch arms also have rounded distal ends 76*a* which project outwardly from the body of the latch arms. With the shield section being stamped and formed from sheet metal material, it can be understood that latch arms 76 define spring arms which are self-biased toward their outwardly projecting positions as shown in FIGS. 1 and 3. As best seen in FIG. 1, rounded distal ends 76*a* of the latch arms project into side openings 82 of outer cover 26, behind front edges 82*a* of the openings.

Figure 6:
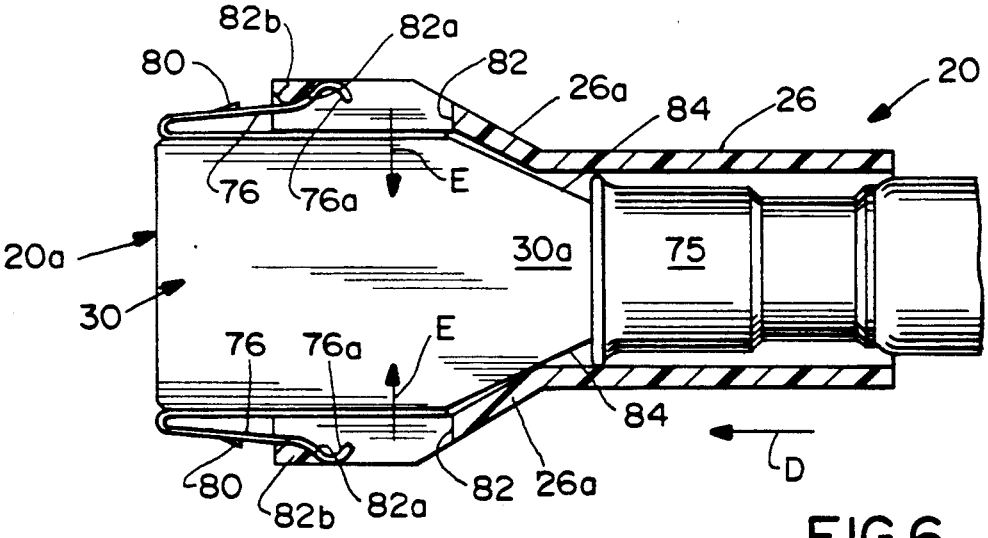
FIG. 6 is a horizontal section through the cover of the plug connector assembly in FIG. 1, illustrating the cover in its mating position allowing the latch means of the connector assembly to move outwardly to its operative latching condition.
Figure 7:
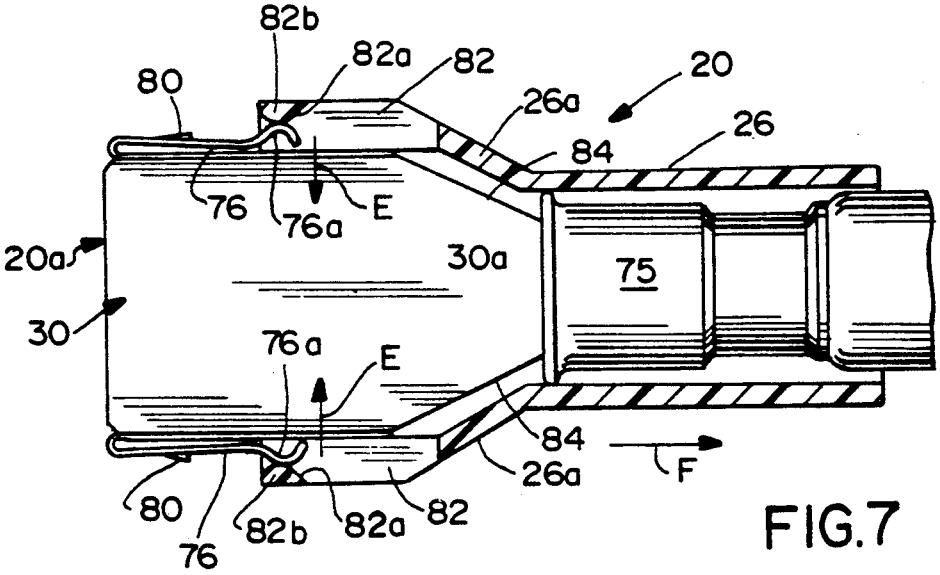
FIG. 7 is a view similar to that of FIG. 6, with the cover moved rearwardly to move the latch means inwardly for unmating the connector assemblies.

Referring to FIGS. 6 and 7 in conjunction with FIG. 1, FIG. 6 shows the position of outer cover 26 as illustrated in FIG. 1. It can be seen that angled walls 26*a* of the cover are in engagement with angled walls 84 of the cable shroud portion of the shield sections. In this position, it can be seen that latch arms 76 are in outwardly projecting, operative latching positions, with openings 82 in the cover, behind front edges 82*a*. When plug connector assembly 20 is moved in a mating direction, as indicated by arrow "D" (FIG. 6), an operator will be grasping the outside of cover 26. With angled walls 26*a* of the cover engaging shields 30 and 32, the front mating plug end 20*a* of plug connector assembly 20 can be inserted into mating receptacle end 22*a* of header connector assembly 22 (FIG. 2). Immediately prior to mating, latch arms 76 angle away from side walls 30*b* in the direction A as shown in FIG. 3. During mating, latch arms 76 will initially contact side walls 136 of header shield 92 and are forced inwards toward side walls 30*b* in the direction "E" (FIG. 6) to permit the latch arms to enter the header shield. Upon insertion, latching tabs 80 of the latch arms snap into apertures 82 (FIG. 2) of the header connector assembly.

When an operator wishes to unmate connector assemblies 20 and 22, the operator grasps cover 26 and pulls on the cover in the direction of arrow "F" (FIG. 7). The cover moves relative to shield 30 and latch arms 76 until the front edge 82*a* of openings 82 engage rounded distal ends 76*a* of the latch arms. The latch arms thereby are forced inwardly in the direction of arrows "E", moving latching tabs 80 out of apertures 82 whereupon the connectors can be unmated. Cover 26 includes a pair of projections (not shown) on the top and bottom of its inner surfaces facing shields 30 and 32, respectively. Upon moving cover 26 in the direction "F", the projections will contact the leading edge 77 of crimpable collar 75 thus preventing the vertical members 82*b* from moving rearwardly past rounded distal ends 76*a* of the latch arms. In essence, the front edge 76*a* of cover 26 and the rounded distal ends 76*a* of the latch arms form complementary engageable cam means between the cover and the latch arms to effect movement of the latch arms to an unlatched position, as shown in FIG. 7, for unmating the connector assemblies.

Figure 11:
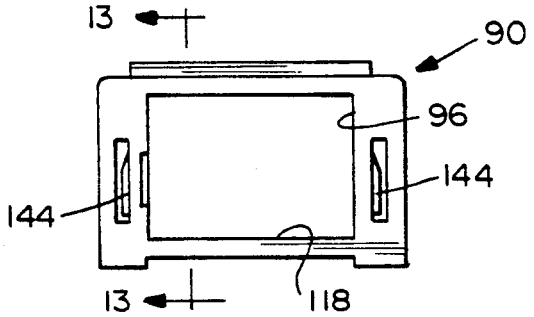
FIG. 11 is a front elevational view of the inner housing of the header connector assembly of FIG. 2.

Turning now to the right angle receptacle or header connector assembly 22 (FIG. 2), the connector assembly includes a dielectric housing, generally designated 90, unitarily molded of plastic material or the like (FIG. 11). A unitary conductive shield, generally designated 92, is fabricated in one piece of stamped and formed sheet metal material (FIG. 1). A plurality of generally flat terminal modules 94 are nested within a module receiving cavity 96 in housing 90, the modules being in a vertical side-by-side relationship. Each terminal module 94 includes a plurality of generally coplanar flat terminals surrounded and maintained in a desired array by an overmolded module encasement, as described in greater detail hereinafter. As visible in FIG. 2, the terminals have terminal pin portions 100 projecting from the modules within a forward shroud portion 93 of shield 92, and tail portions 98 projecting out of the bottom of the connector assembly for insertion into appropriate holes in a substrate such as a printed circuit board or the like for termination to circuit traces on the board.

Figure 8:
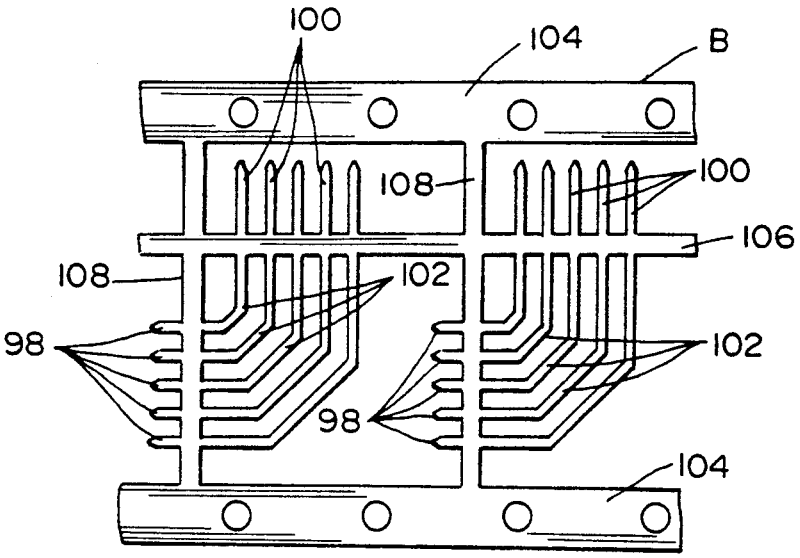
FIG. 8 is a plan view of a blank of sheet metal material from which the terminals of the header connector assembly of FIG. 2 are fabricated.

FIG. 8 illustrates how the terminals for header connector assembly 22 are mass produced from a stamped blank, generally designated "B", of sheet metal material in strip form. Groups of five terminals 102 are stamped from the blank in right-angled configurations, defining terminal pin portions 100 and tail portions 98 at opposite, right-angularly directed ends of the terminals. The blank includes indexing strips 104 movable through appropriate application stamping tooling, with longitudinal webs 106 and cross webs 108 spanning the groups of terminals and traversing strips 104, respectively. For purposes described hereinafter, it can be understood that the flat faces or sides of terminals 102 which are stamped from the sides of the sheet metal blank are generally smooth in comparison to the edges of the terminals which are formed by a stamping operation.

Figure 9:
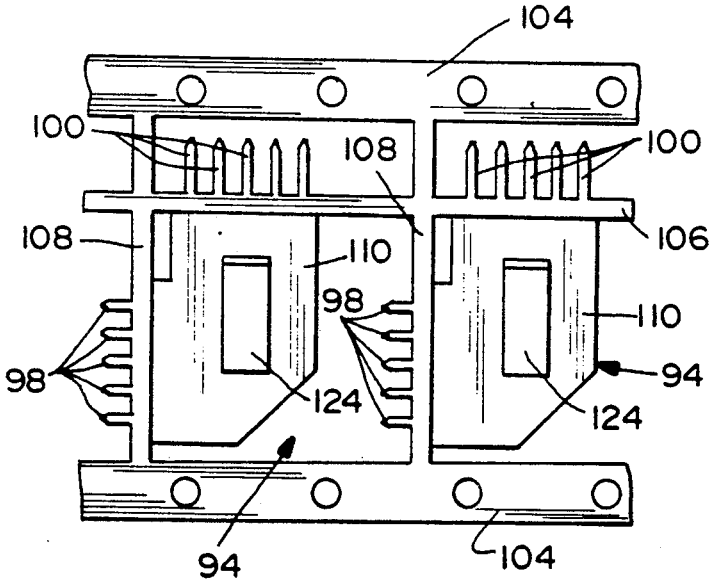
FIG. 9 is a view similar to that of FIG. 8, illustrating the overmolded encasements for the terminals.
Figure 10:
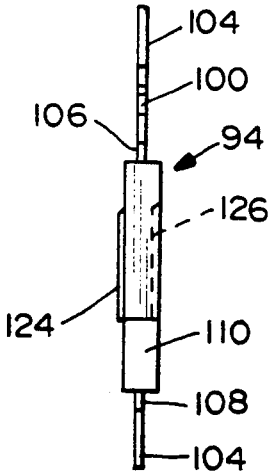
FIG. 10 is an end view, as looking toward the right-hand end of FIG. 9.

FIGS. 9 and 10 illustrate an overmolded encasement 110 which completely surrounds the right-angled terminals 102, as viewed in FIG. 8, leaving pin portions 100 and tail portions 98 projecting from the overmolded encasement. After the terminals are overmolded with encasement 110, webs 106 and 108 are severed in line with the stamped edges of pin portions 100 and tail portions 98, leaving right-angled terminal modules 94 (FIG. 2) including the terminals surrounded by the overmolded encasements.

Comparing FIGS. 9 and 10 with FIG. 2, it can be seen that terminal modules 94 are nested within cavity 96 of housing 90 in an array of six vertical modules of five terminals in a side-by-side relationship for insertion into the corresponding row-array of pin-receiving openings 46 in plug connector assembly 20 (FIG. 1).

Figure 12:
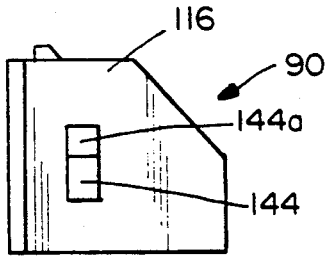
FIG. 12 is a side elevational view of the housing of FIG. 11, as looking toward the right-hand side of FIG. 11.
Figure 13:
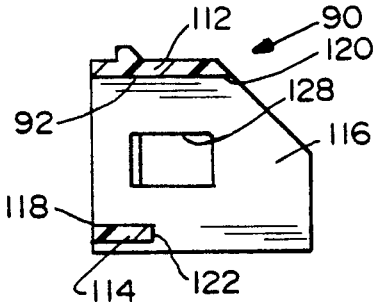
FIG. 13 is a vertical section taken generally along line 13—13 of FIG. 11.

FIGS. 11–13 show the configuration of housing 90 of header connector assembly 22, including module receiving cavity 96 (FIGS. 11 and 13). The housing is unitarily molded of dielectric material and includes a top wall 112, a bottom wall 114 and opposite side walls 116. The front of the housing is open, as at 118, and through which terminal pin portions 100 project. The rear of the housing is open, as at 120, and the bottom of the housing is partially open, as at 122, for insertion of right-angled modules 94 into the housing with terminal tail portions 98 projecting out of the bottom of the housing for mounting in appropriate holes in the printed circuit board.

Complementary interengaging locking means are provided on opposite sides of terminal modules 94 for holding the modules together in their side-by-side relationship within cavity 96 of housing 90. Specifically, as seen in FIGS. 9 and 10, one side of each encasement 110 is provided with a projecting boss 124 and the opposite side of each encasement is provided with a complementarily shaped indented recess 126 (FIG. 10). The bosses and detents are rectangularly shaped such that when the terminal modules are juxtaposed in their side-by-side relationship, the bosses of the modules project into the recesses of adjacent modules, thereby locking all of the modules together. In addition, side walls 116 of housing 90 may be molded with a recess 128 (FIG. 13) for the left-hand side wall and a boss (not shown) for the right-hand side wall for locking the interlocked modules within the housing.

Figure 14:
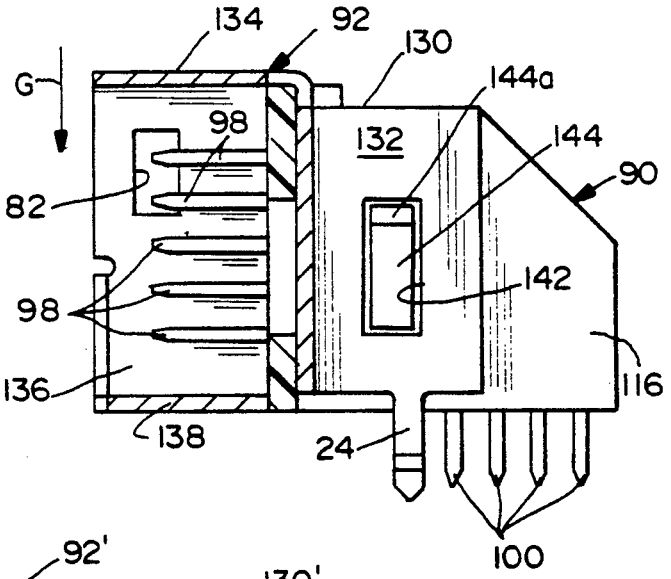
FIG. 14 is a vertical section through the front shroud portion of the shield of the header connector assembly, taken generally along line 14—14 of FIG. 2, illustrating the rear of the connector assembly in elevation.

Referring to FIG. 14 in conjunction with FIG. 2, unitary conductive shield 92 includes a top wall 130 for covering a portion of the top dielectric housing 90, opposite side walls 132 for covering portions of side walls 116 of the housing and a generally rectangular shroud wall means 93 substantially surrounding the terminal pin portions 100 of terminals 102 that project from the front of the housing. Specifically, as seen from the above description, the front of dielectric housing 90 is generally rectangular in shape. The shroud wall means 93 of unitary conductive shield 92 includes four walls in the form of a top wall portion 134, opposite side wall portions 136, and a bottom wall portion 138. These wall portions combine to define a rectangular shroud complementary in shape and projecting from the rectangular front of housing 90 and surrounding the projecting pin portions 100 of terminals 102. Conductive shield 92 is fabricated in one piece from sheet metal material, and bottom wall portion 138 of the terminal pin shroud actually is fabricated by two sections meeting at a seam line 140 (FIG. 2).

When assembled, unitary conductive shield 92 of header connector assembly 22 is mounted onto dielectric housing 22. The shield simply is positioned onto the top of the housing, generally in the direction of arrow "G" (FIG. 14), and latch means are provided between the housing and the shield to hold the shield on the housing. The latch means is provided in the form of apertures 142 in side walls 132 of the shield for receiving outwardly projecting bosses 144 projecting outwardly from side walls 116 of the housing. It can be seen that the top portions of bosses 144 are chamfered, as at 144*a*, to guide the shield side walls over the bosses and allow the side walls to snap into abutment with the sides of the housing once apertures 142 come into registry with bosses 144.

Figure 15:
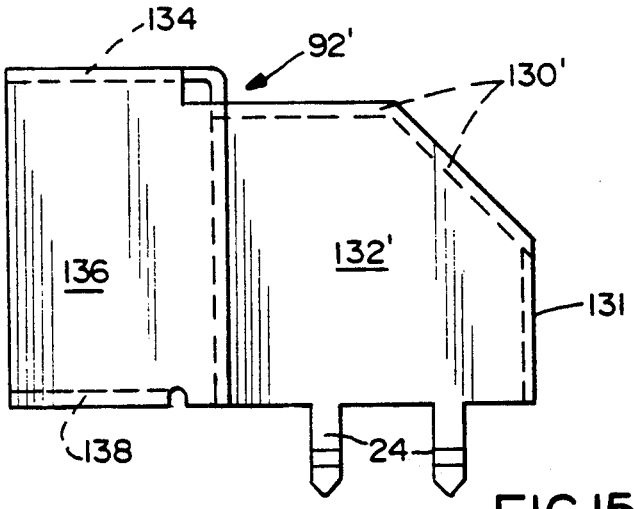
FIG. 15 is a side elevational view of a modified form of shield for the header connector assembly.

FIG. 15 somewhat schematically illustrates an alternative unitary shield, generally designated 92', which has an angled top wall 130', backwall 131 and side walls 132' for covering substantially the entirety of the top, back and opposite sides of dielectric housing 90. It also has a second board lock leg 24 located on each side of the housing. Otherwise, like numerals have been applied to the shield corresponding to like portions or walls thereof described in relation to shield 92 (FIGS. 2 and 14).

Polarization of the plug and receptacle assembly is provided by fingers 150 integrally formed at the front of side wall 136 and adjacent bottom wall 138 of shield shroud 93. Dielectric outer cover 26 of plug 20 includes stepped portions 152 on each side adjacent the bottom portion of the plug. The width of the cover at the stepped portions is less than the width of the upper portion of the plug and such reduced width is slightly less than the distance between finger 150 to permit insertion of the plug into the receptacle when properly oriented. If the plug were attempted to be inserted upside down into the receptacle, the latch arms 76 which are located above the center point of the plug or vertical members 82*b* would contact finger 150 thus preventing mating of the connectors.

Finally, a feature of the right angle header connector assembly 22, particularly in the orientation of terminal modules 94 and terminals 102, is to orient the terminals whereby smooth flat sides of projecting terminal pin portions 100 engage corresponding smooth portions of terminals 36 (FIG. 3). More particularly, terminal 36 is a female terminal defined by a pair of opposing beams 150. Each terminal 36 is fabricated of stamped and formed sheet metal material, whereby beams 150 comprise generally parallel portions of the smooth sides of the sheet metal from which the terminal is stamped and formed. In comparing terminal-receiving modules 34 of plug connector assembly 20 (FIG. 1) with terminal modules 9 of header connector assembly 22 (FIG. 2), it can be seen that terminal-receiving modules 34 are in an array of five horizontal modules of six terminals, whereas terminal modules 94 are in an array of six vertical modules of five terminals. In this manner, it can be understood from the description of fabricating modules 94 in relation to FIGS. 8 and 9, that the smooth sheet metal sides of terminal pin portions 100 engage the smooth sheet metal sides of jaws 150 of female terminals 36. Therefore, the contacting surfaces between the male and female surfaces cause less wear to plating materials on the terminals during mating and unmating of the connector assembly.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector assembly, comprising:

a housing having an open-ended cavity, the housing being unitarily molded of dielectric material;

a plurality of terminal-receiving modules each being unitarily molded of dielectric material and sized and shaped to be juxtaposed in a nested array for positioning in the cavity of the housing through the open end thereof; and complementary interengageable latch means between the housing and each terminal-receiving module to hold all the modules in their nested array within the cavity, the latch means being molded integral with the housing and the modules, the latch means including a pair of common latches disposed on opposite sides of the housing and individual latches disposed on end surfaces of the modules, each common latch extending along the array of modules for engagement with the individual latches thereof and comprising a cantilever portion of said opposite sides.

2. The electrical connector assembly of claim 1 wherein said cavity is generally rectangularly shaped, and said modules are elongated with lengths each generally equal to one cross-dimension of the rectangular cavity and with the total of the widths of all of said modules being generally equal to the opposite cross-dimension of the rectangular cavity.

3. A shielded electrical connector assembly, comprising:

an insulating housing have a top, a bottom and opposite sides;

top and bottom conductive shield sections tamped and formed from metal material and positionable over the top and bottom, respectively, of the housing, each shield section including side walls overlying at least portions of the sides of the housing; and complementary interengageable latch means between the sides of the housing and the side walls of each of the shield sections for holding the shield sections on the housing, said latch means including only one channel molded in and extending along each side wall generally parallel to said top and bottom of the housing, and at least one latching tab formed from each side wall of the shield sections, each latching tab snapping into one of the channels on the housing.

4. A shielded electrical connector assembly for mating with an appropriate mating connector assembly, comprising:

an insulating housing having a top, a bottom and opposite sides;

a stamped and formed shield member including separate top and bottom conductive shield components positioned over the top and bottom respectively, of the housing, each shield component including side walls overlying at least portions of the sides of the housing;

latch arms integrally formed from said shield member and folded rearwardly from front edges of the side walls of the shield member for latching the connector assembly to said appropriate mating connector assembly, said latch arms extending rearwardly outside the periphery of said insulative housing and having latching tabs thereon, the latch arms being movable between an operative latching position when the connectors are mated and an inoperative unlatching position to allow unmating of the connectors, an outer cover about at least a portion of the housing and movable relative thereto in a mating/unmating direction, said outer cover including recess means for accommodating the latch arms in their operative latching position; and complementary engageable cam means between the outer cover and the latch arms for moving the latch arms to the inoperative unlatching position when the cover is moved relative to the housing in the unmating direction and for allowing movement of the latch arms to the operative latching position when the cover is moved relative to the housing in the mating direction.

5. An electrical connector, comprising:

an inner connector assembly including a stamped and formed metal shield and a pair of spring latch arms integrally formed with and folded rearwardly from front edges of said shield for latching the connector assembly to an appropriate mating connector, the latch arms being movable between an operative latching position when the connectors are mated and an inoperative unlatching position to allow unmating of the connectors, the latch arms further being normally biased outwardly of the inner connector assembly toward said operative latching position;

an outer cover about at least a portion of the inner connector assembly and movable relative thereto in a mating/unmating direction, said outer cover including recess means for accommodating the latch arms in their outwardly biased operative latching position; and complementary engageable cam means between the outer cover and the latch arms for moving the latch arms to the inoperative unlatching position when the cover is moved relative to the inner connector assembly in the unmating direction and for allowing movement of the latch arms to the operative latching position when the cover is moved relative to the inner connector assembly in the mating direction.

6. The electrical connector of claim 5 wherein said complementary engageable cam means include a cam portion on the outer cover for moving the latch arm inwardly against said bias toward the inoperative unlatching position when the cover is moved relative to the inner connector assembly in said unmating direction.

7. The electrical connector of claim 5, including stop means between the outer cover and the inner connector assembly to limit movement of the cover relative to the inner connector assembly in said mating direction.

* * * * *